US007536893B2

(12) United States Patent
Urabe

(10) Patent No.: US 7,536,893 B2
(45) Date of Patent: May 26, 2009

(54) AUTOMATIC BENDING MACHINE FOR MANUFACTURING OF STEEL RULE CUTTING DIES

(76) Inventor: Toshinaga Urabe, 3-20-21, Sounan, Sagamihara-shi, Kanagawa-ken 228-0812 (JP)

( * ) Notice: Subject to any disclaimer, the term of this patent is extended or adjusted under 35 U.S.C. 154(b) by 0 days.

(21) Appl. No.: 11/583,174

(22) Filed: Oct. 19, 2006

(65) Prior Publication Data

US 2007/0089472 A1 Apr. 26, 2007

(30) Foreign Application Priority Data

Oct. 21, 2005 (JP) ..... 2005-334918

(51) Int. Cl.
*B21D 11/00* (2006.01)
*B21D 5/16* (2006.01)

(52) U.S. Cl. ..... 72/307

(58) Field of Classification Search ..... 72/307, 72/319, 388, 387, 217, 214
See application file for complete search history.

(56) References Cited

U.S. PATENT DOCUMENTS 5,507,168 A * 4/1996 Mizukawa et al. ..... 72/387
5,787,750 A 8/1998 Song
6,158,264 A 12/2000 Mizukawa
6,308,551 B1 * 10/2001 Park ..... 72/307
6,629,442 B2 * 10/2003 Park ..... 72/307
2002/0066299 A1 6/2002 Park
2006/0260377 A1 * 11/2006 Kane et al. ..... 72/307

FOREIGN PATENT DOCUMENTS

JP 11-347828 12/1999
JP 2001-314932 11/2001
JP 2005-279772 10/2005

* cited by examiner

*Primary Examiner*—Dana Ross
*Assistant Examiner*—Debra M Sullivan
(74) *Attorney, Agent, or Firm*—Wenderoth, Lind & Ponack, L.L.P

(57) ABSTRACT

An automatic bending machine is provided for automatically bending a strip blade material, wherein the automatic bending machine intermittently feeds the strip blade material through a nozzle until the strip blade material is jutted out from a nozzle gate at the end of the nozzle, and causes a CW-direction bending tool or a CCW-direction bending tool to be turned in a clockwise direction or a counterclockwise direction, respectively, to strike the strip blade material for bending it. The CW-direction bending tool and the CCW-direction bending tool are provided with a bending tool support extending at right angles thereto and a ring having a concentric hole, at the top and bottom of the CW-direction bending tool and the CCW-direction bending tool, respectively, and a shaft penetrating through the rings of the CW-direction bending tool and the CCW-direction bending tool that are superposed one upon another.

4 Claims, 11 Drawing Sheets

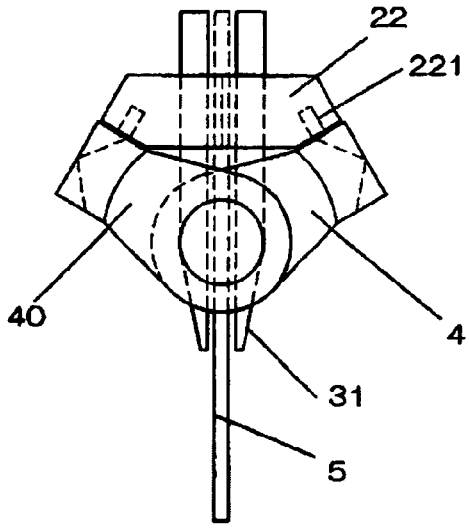
FIG.4-A
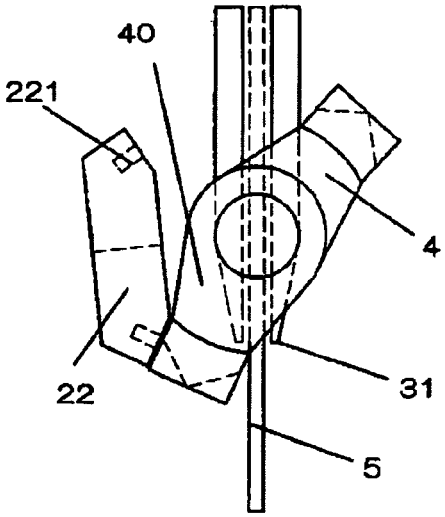
FIG.4-B
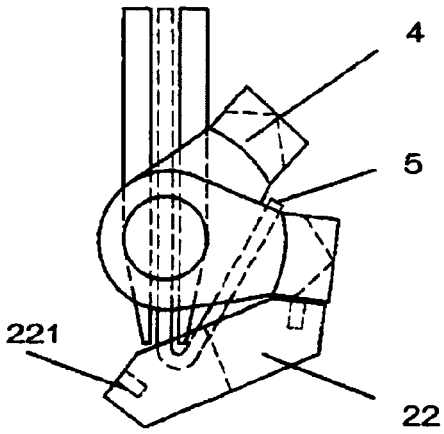
FIG.4-C

FIG.5-A
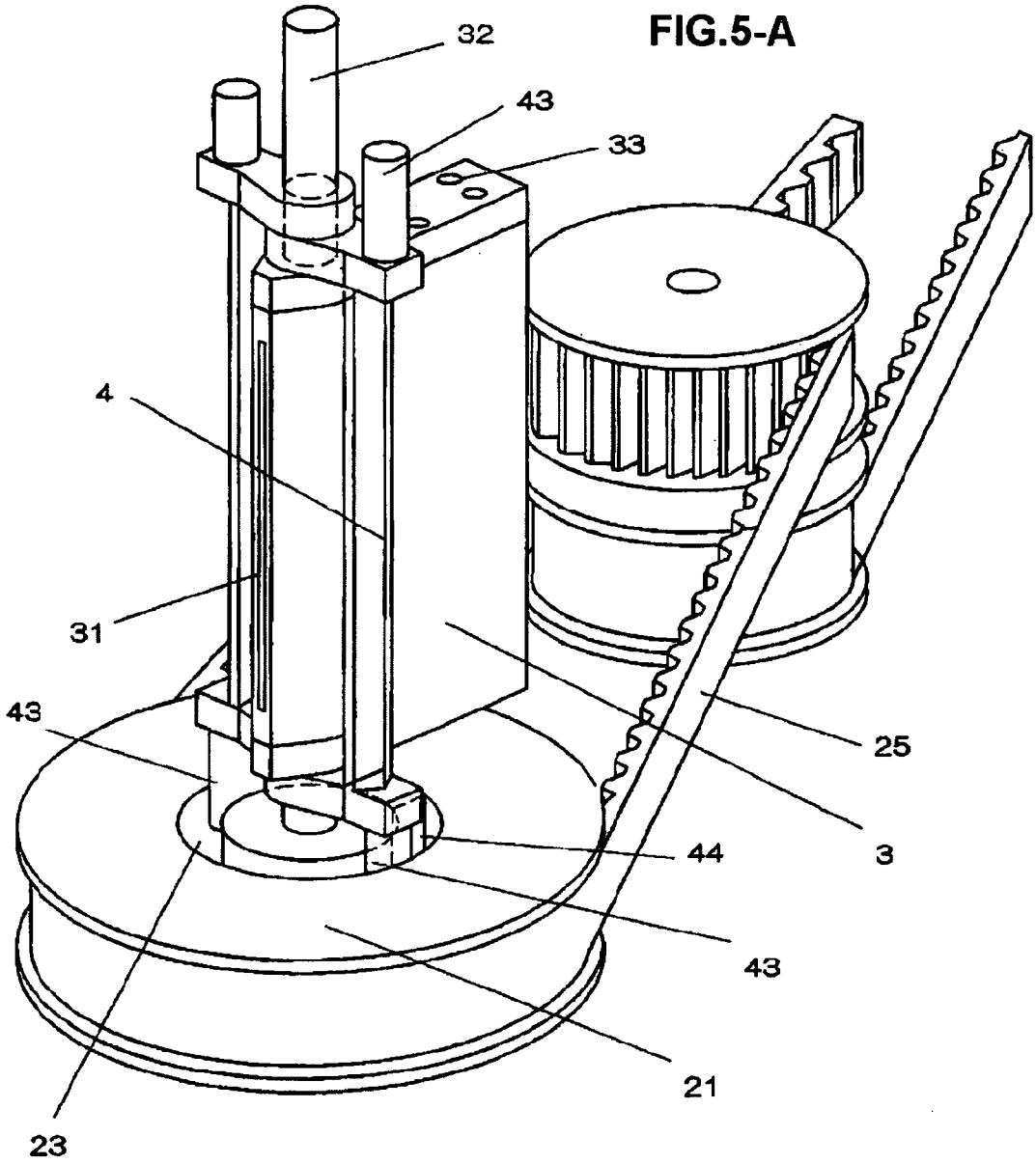
FIG.5-B
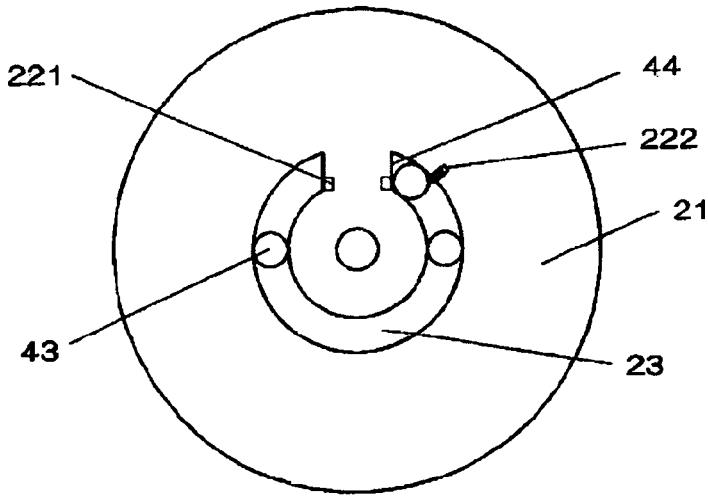

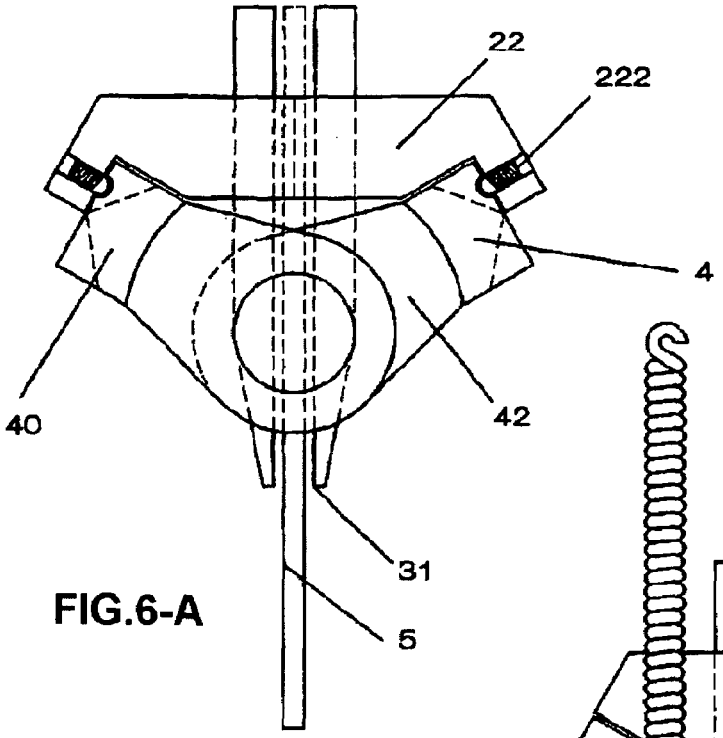
FIG.6-A
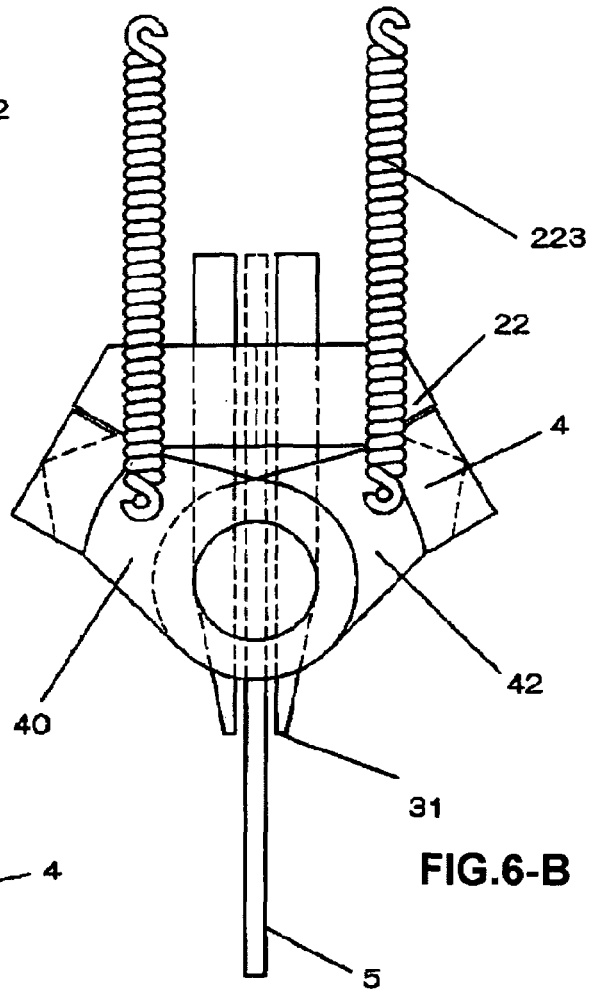
FIG.6-B
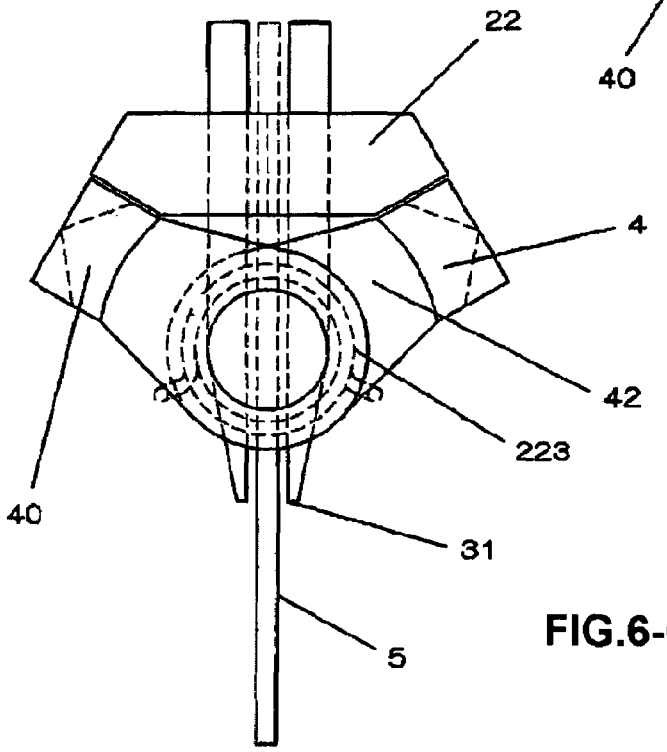
FIG.6-C

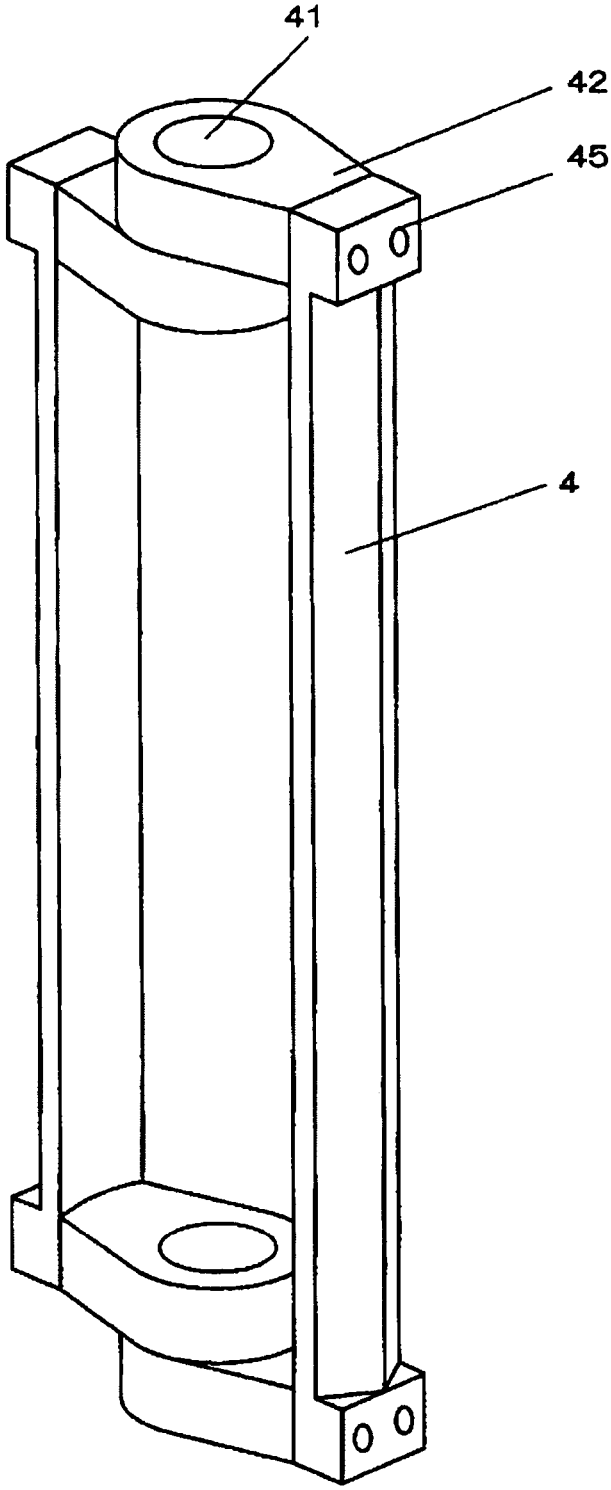
FIG.7-A
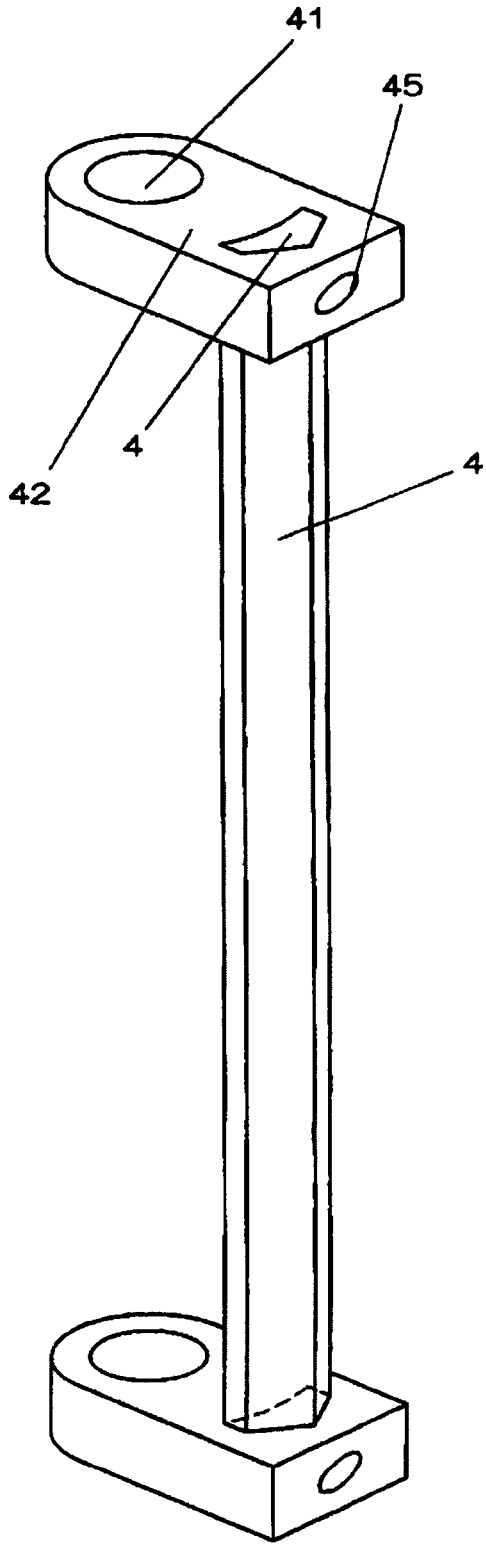
FIG.7-B

FIG.8-A
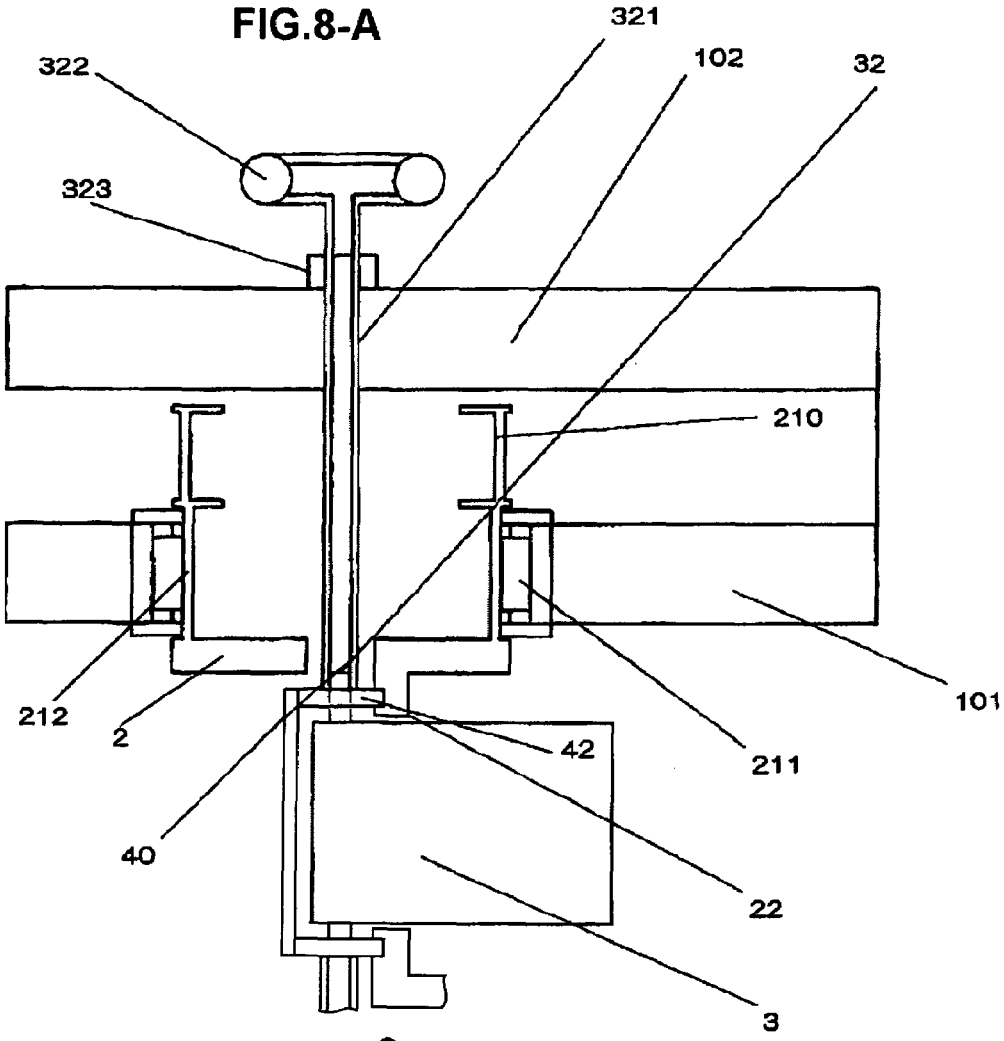
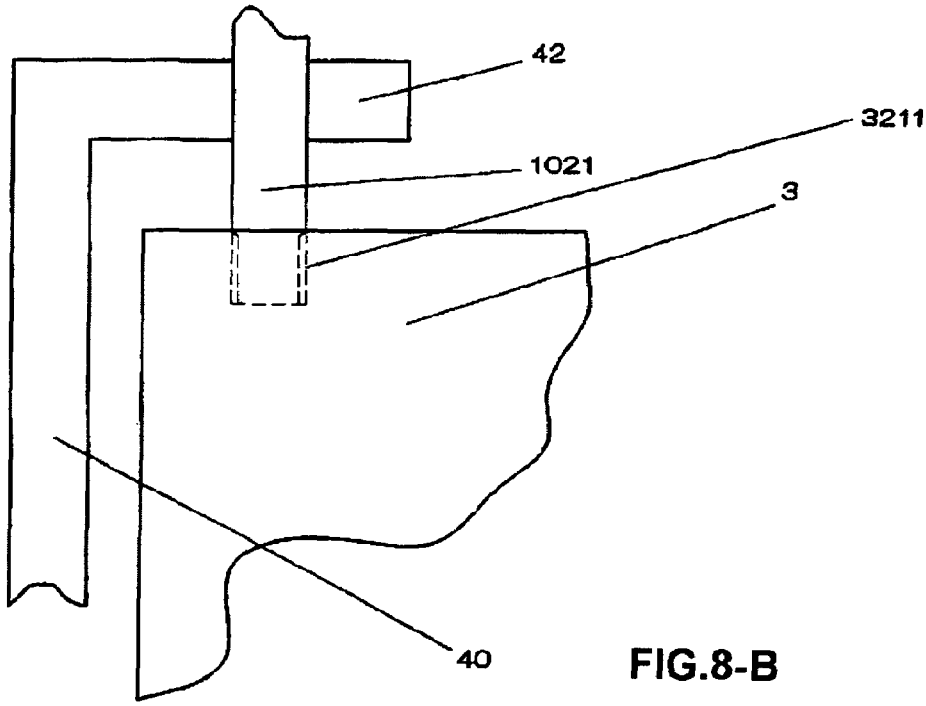
FIG.8-B

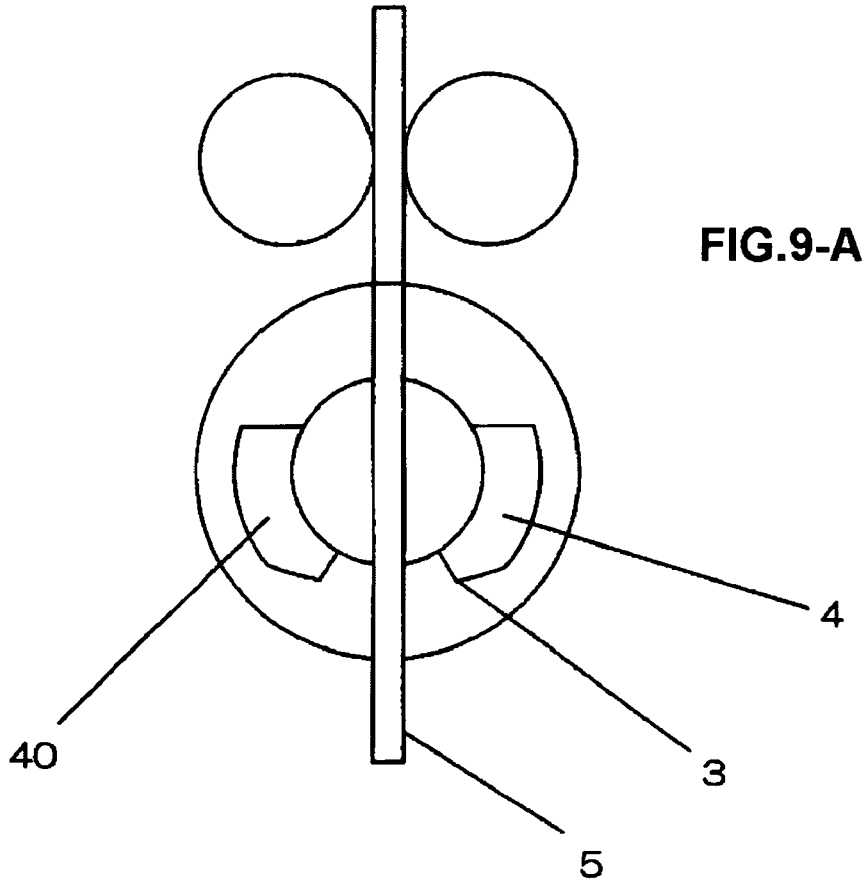
FIG.9-A
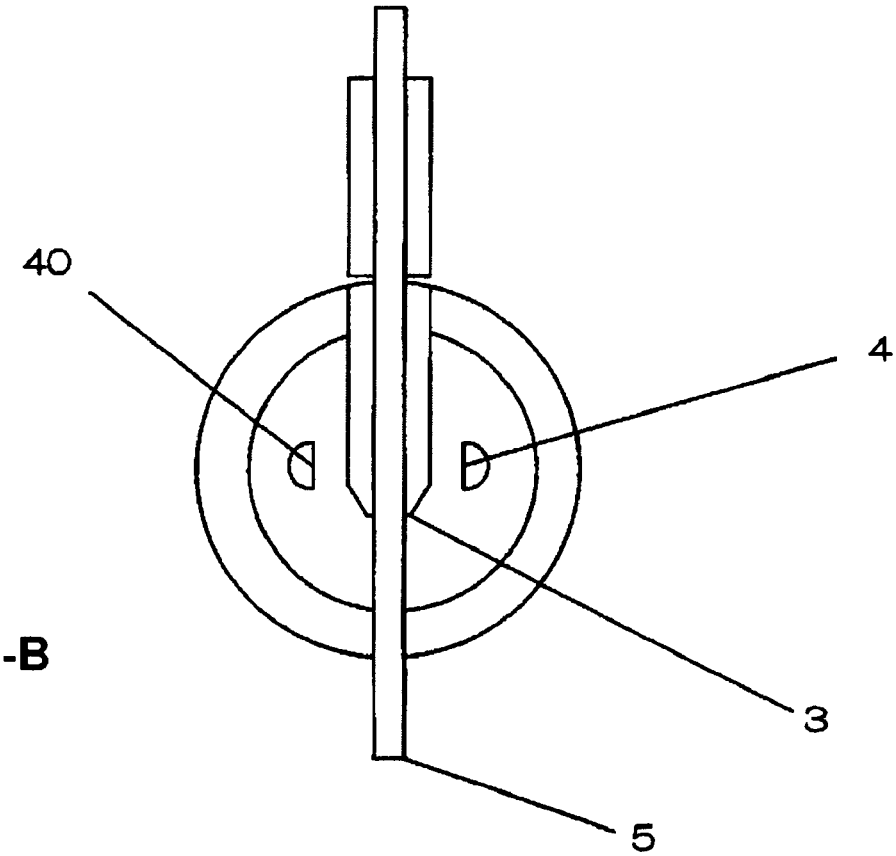
FIG.9-B

AUTOMATIC BENDING MACHINE FOR MANUFACTURING OF STEEL RULE CUTTING DIES

BACKGROUND OF THE INVENTION

Field of the Invention

The present invention provides an improvement of the patent application No. 2004-127369 (Japanese Patent Laid-Open Publication No. 2005-279772), which is the prior application by the present inventor. It relates to an automatic bending machine for the manufacturing of steel rule cutting dies which are used to form a prescribed cut or rule on a cardboard, a corrugated board, or the like, in manufacturing a paper container, a corrugated board container, or the like, and particularly to an automatic bending machine for carrying out bending, cutting, and the like, of a strip blade material constituting a steel rule cutting die.

Since 1988, when Suehiro Mizukawa disclosed the world's first automatic bending machine for manufacturing of steel rule cutting dies (provided with a trade name of BBS-101), the automatic bending machine of this type has been greatly improved. For example, in the following patent documents 1 and 2, an automatic bending machine for carrying out bending, cutting, and the like, of a strip blade material constituting a steel rule cutting die is disclosed.

Patent document 1: U.S. Pat. No. 6,629,442

Patent document 2: U.S. Pat. No. 5,787,750

Patent document 3: Japanese Patent Publication No. JP/11-347828A/1999

Patent document 4: Japanese Patent Publication No. JP/2001-314932A

The bending tool of U.S. Pat. No. 6,158,264 by Suehiro Mizukawa was a bending tool which is concentrically operated, as shown in FIG. 9-A, and thus the maximum bending angle was 90 deg. The bending tool can actually be turned through an angle of over 90 deg, however, because a spring-back occurs with the strip blade material 5 bent, the maximum bending angle was limited to 90 deg. This mechanism is simple, providing a sturdy tooling, thus being high in reliability. In addition, the simple construction requires no extra motor or cylinder. The construction of interest is integral and robust, but if turning the bending tool through an angle of over 90 deg will cause the edge of the back portion to be contacted with the strip blade material 5 supplied, the bending tool cannot be turned through an angle of over 90 deg.

Conventionally, bending tools which have a bending capacity of more than 90 deg have been available; for example, those as disclosed in U.S. Pat. No. 4,627,255 and U.S. Pat. No. 5,787,750. With such a tooling, a single bending tool is turned around from one side of the strip blade material 5 to the other. The bending tool is once lowered beyond the bottom of the strip blade material 5, turned around to the other side thereof, and then raised. Thus, there is the possibility that the bending tool may be struck against the bottom of the workpiece, resulting in jamming, when moved upward. In addition, the bending tool is turned around, which takes extra working time. Because the bending tool is only inserted, there was the need for introducing a synchronizing mechanism in order to eliminate the possibility of damaging it. In addition, an extra mechanism for vertically moving the bending tool is required. (Referring to the construction as shown in FIG. 9-B)

The bending mechanism as disclosed in U.S. Pat. No. 6,629,442 provides a complex construction in which two bending tools are incorporated in a double gear, one of them being turned in a clockwise direction by the gear which is vertically moved by a separate motor, and the other being turned counterclockwise.

SUMMARY OF THE INVENTION

The most important purpose of the present invention is to provide a bending tool which is sturdy and precise, having a capability of bending the workpiece to an angle as deep as over 90 deg, without the need for using any extra device, such as motor, cylinder, and the like.

The present invention provides an automatic bending machine for automatically bending a strip blade material, wherein the automatic bending machine intermittently feeds a strip blade material 5 through a nozzle 3 until the strip blade material 5 is jutted out from a nozzle gate 31 at the end of the nozzle 3, and causes a CW-direction bending tool 4 or a CCW-direction bending tool 40 to be turned in a clockwise direction or a counterclockwise direction, respectively, to strike the strip blade material 5 for bending it. The CW-direction bending tool 4 and the CCW-direction bending tool 40 are provided with a bending tool support 42 extending at right angles thereto and a ring 421 having a concentric hole 41, at the top and bottom of the CW-direction bending tool 4 and the CCW-direction bending tool 40, respectively. A shaft 10210 penetrates through the rings 421 of the CW-direction bending tool 4 and the CCW-direction bending tool 40 that are superposed one upon another, and a protrusion 22 is provided on the top of a lower belt wheel 21 turned under the control of a computer, being in contact with the bending tool support 42. More specifically, when the lower belt wheel 21 is turned, the protrusion 22 thereon is also turned. And, when the protrusion 22 is turned clockwise or counterclockwise, it forces the CW-direction bending tool 4 or the CCW-direction bending tool 40 to strike the strip blade material 5 for bending it in a CW or CCW direction, respectively.

The automatic bending machine for automatically bending a strip blade material of the present invention may be configured such that an upper belt wheel 2 is provided in a lower machine cabinet 101 extending from a machine cabinet 1 in concentricity with the nozzle column 32 or the reinforcing rod 1021 independently of the nozzle column 32 or the reinforcing rod 1021.

Further, the automatic bending machine for automatically bending a strip blade material of the present invention may be configured such that the nozzle column 32 is connected to an upper reinforcing tube 321 provided in an upper machine cabinet 102 extending from a machine cabinet 1 for reinforcement, in order to allow the nozzle 3 to withstand the striking impact applied by the CW-direction bending tool 4 or the CCW-direction bending tool 40.

In addition, the automatic bending machine for automatically bending a strip blade material of the present invention may be configured such that a magnet 221 or a ball plunger 222 is provided for a protrusion 22 or a groove stopper 44, or a spring 223 is provided for a bending tool support 42, in order to rapidly return the CW bending tool 4 or the CCW bending tool 40 from the working position to a retract position.

Further, the automatic bending machine for automatically bending a strip blade material of the present invention may be configured such that the nozzle column 32 is connected to a reinforcing tube 321 provided in the upper machine cabinet 102 extending from the machine cabinet 1 by means of a screw. By providing such a configuration, removing the reinforcing tubes 321 will allow the nozzle 3, the CW-direction bending tools 4, the CCW-direction bending tools 40, and the like to be pulled forward from the machine cabinet 1 together with the nozzle supports 11, facilitating the tooling replacement.

The present invention may be adapted to provide a shaft 10210 with which a nozzle column 32 and a nozzle 3 are integrated with each other for robust construction, and provide bending tools 4, 40 which are robust, having an integral construction, and to which the shaft 10210 is assembled, concentrically penetrating them.

EFFECTS OF THE INVENTION

Because, with the present invention, two different bending tools are provided as described above, bending by an angle of over 90 deg can be performed.

Because, with the present invention, two different bending tools are provided as described above, there is no need for the bending tool to be vertically moved to the opposite side, and thus tool jamming will not occur.

Because, with the present invention, two different bending tools are provided as described above, there is no need for the bending tool to be vertically moved to the opposite side, and thus the working time can be saved. In addition, the CW-direction bending tool 4 or the CCW-direction bending tool 40 turned for striking can be retracted with the magnet 221 or the spring 223 for the subsequent bending.

Because, with the present invention, two different bending tools are provided as an integral part, as described above, the rigidity of the CW-direction bending tool 4 and the CCW-direction bending tool 40 can be maintained, which assures bending with high accuracy. The "integral part" means that the tool is fixed with screws, or the like, rather than being temporarily inserted.

Because, with the present invention, no extra motor and cylinder are required as described above, the control system can be manufactured at a lower cost. In addition, the problems which would be caused by the extra motor and cylinder can be eliminated.

Because, with the present invention, the nozzle column 32 may be connected with the reinforcing tube 321 in the upper machine cabinet 102 as described above, the nozzle 3 can be adapted to withstand the striking impact applied by the CW-direction bending tool 4 or the CCW-direction bending tool 40.

With the present invention, the nozzle column 32 may be connected to a reinforcing tube 321 provided in the upper machine cabinet 102 extending from the machine cabinet 1 by means of the screw, as described above, and thus by providing such a configuration, removing the reinforcing tubes 321 will allow the nozzle 3, the CW-direction bending tools 4, the CCW-direction bending tools 40, and the like to be pulled forward from the machine cabinet 1 together with the nozzle supports 11, facilitating the tooling replacement. For example, the tooling for blades of 2 P with a thickness of 0.72 mm can be easily replaced with that for blades of 3 P with a thickness of 1.08 mm.

The present invention may be adapted to provide a shaft 10210 with which a nozzle column 32 and a nozzle 3 are integrated with each other for robust construction, and provide bending tools 4, 40 which are robust, having an integral construction, and to which the shaft 10210 is assembled, concentrically penetrating them. Therefore, the looseness due to a long period of operation, which can be caused with an assembling type bending tool 4, 40, as shown in FIG. 7-A and FIG. 7-B can be prevented.

The present invention may be adapted to provide a shaft 10210 with which a nozzle column 32 and a nozzle 3 are integrated with each other, and provide robust bending tools 4, 40, such that these three can be assembled as one set in a short period of time, and thus when, for example, the tooling for blades of 2 P with a thickness of 0.72 mm is to be replaced with that for blades of 3 P with a thickness of 1.08 mm, the replacement operation can be performed in an extremely short period of time. Thereby, a problem presented by the conventional machine which is provided with a nozzle 3 and a bending tool 4, 40 having a complicated construction, i.e., a problem that another costly machine might have to be purchased has been eliminated.

BRIEF DESCRIPTION OF THE DRAWINGS

FIG. 4-A, FIG. 4-B, and FIG. 4-C are plan views illustrating an embodiment of the process of bending a strip blade material of the present invention;

FIG. 5-A is a perspective view illustrating a second embodiment of the automatic bending machine of the present invention;

FIG. 5-B is a sectional plan view illustrating the configuration of the guide groove and guide protrusion in the above-mentioned second embodiment;

FIG. 6-A, FIG. 6-B, and FIG. 6-C are perspective views illustrating second, third, and fourth types of bending tool puller-back element used with the present invention, respectively;

FIG. 7-A is a perspective view illustrating a second embodiment of the bending tool of the present invention;

FIG. 7-B is a perspective view illustrating a third embodiment of the bending tool of the present invention;

FIG. 8-A is a sectional side view of a third embodiment of the automatic bending machine of the present invention (drawing of the lower half section of the apparatus being omitted);

FIG. 8-B is a partially enlarged sectional side view of a modification of the above-mentioned third embodiment of the automatic bending machine of the present invention;

FIG. 9-A and FIG. 9-B are plan views of bending tools of the prior art;

FIGS. 10-1, FIGS. 10-2, and FIGS. 10-3 are a side sectional view of a fourth embodiment of the automatic bending machine of the present invention, a perspective view of a shaft of the same, and a perspective view of bending tools illustrating an unfeasible assembly, respectively;

FIGS. 11-1; FIGS. 11-2 and FIGS. 11-3; and FIGS. 11-4 are a plan sectional view, front sectional views, and a perspective view illustrating the relationship between the shaft and the bending tools of the fourth embodiment of the automatic bending machine of the present invention.

DETAILED DESCRIPTION OF THE INVENTION

Hereinbelow, exemplary embodiments of the present invention will be described with reference to the attached drawings.

Figure 1:
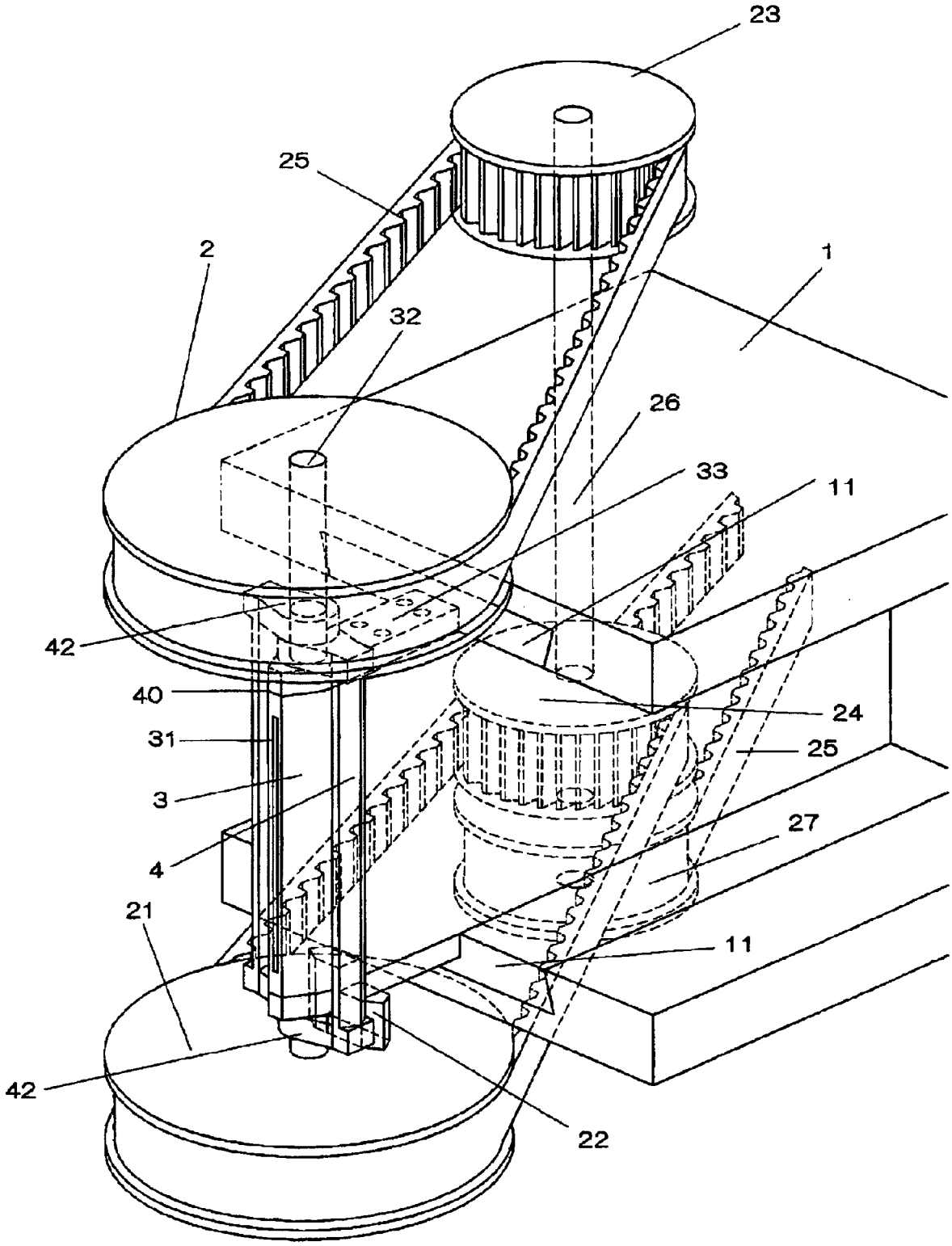
FIG. 1 is a perspective view illustrating a first embodiment of the automatic bending machine of the present invention.
Figure 2:
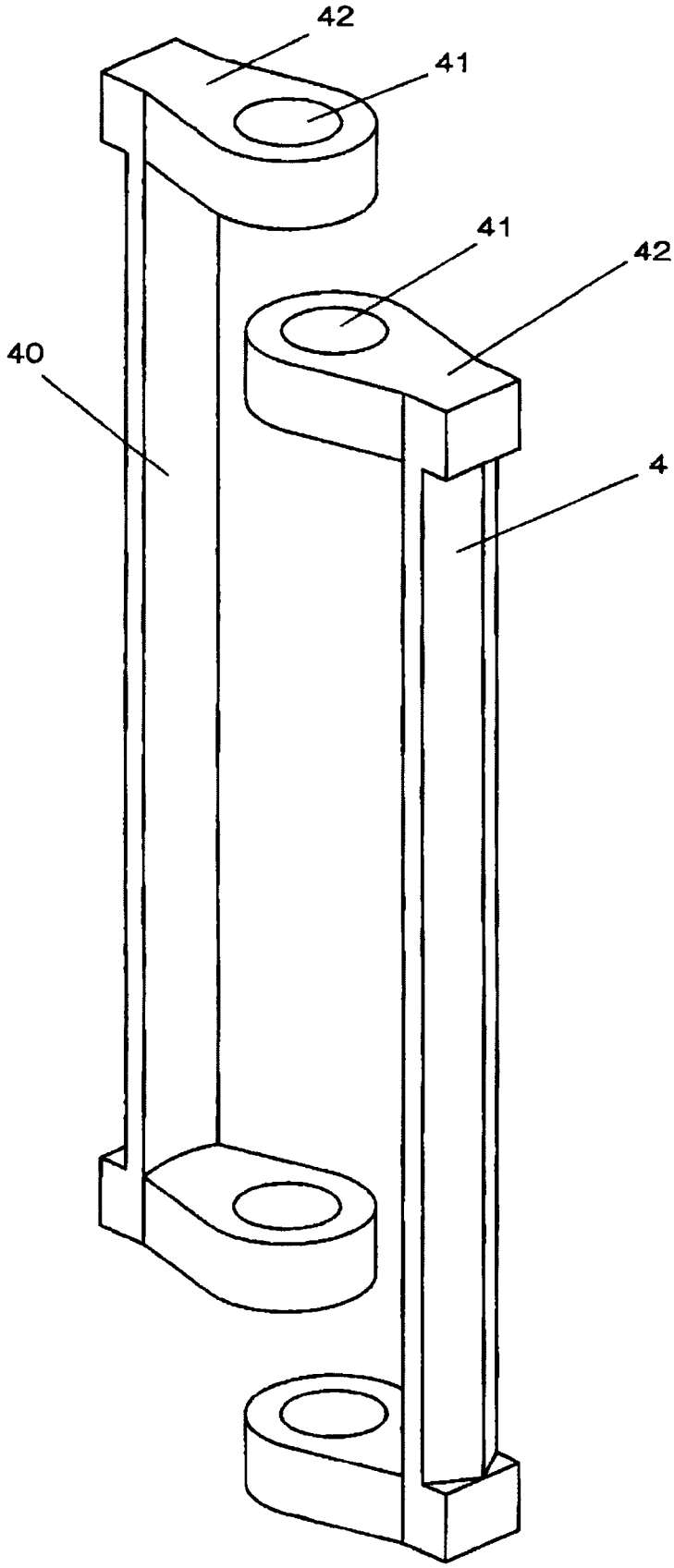
FIG. 2 is a perspective view illustrating a first embodiment of the bending tool of the present invention.
Figure 3:
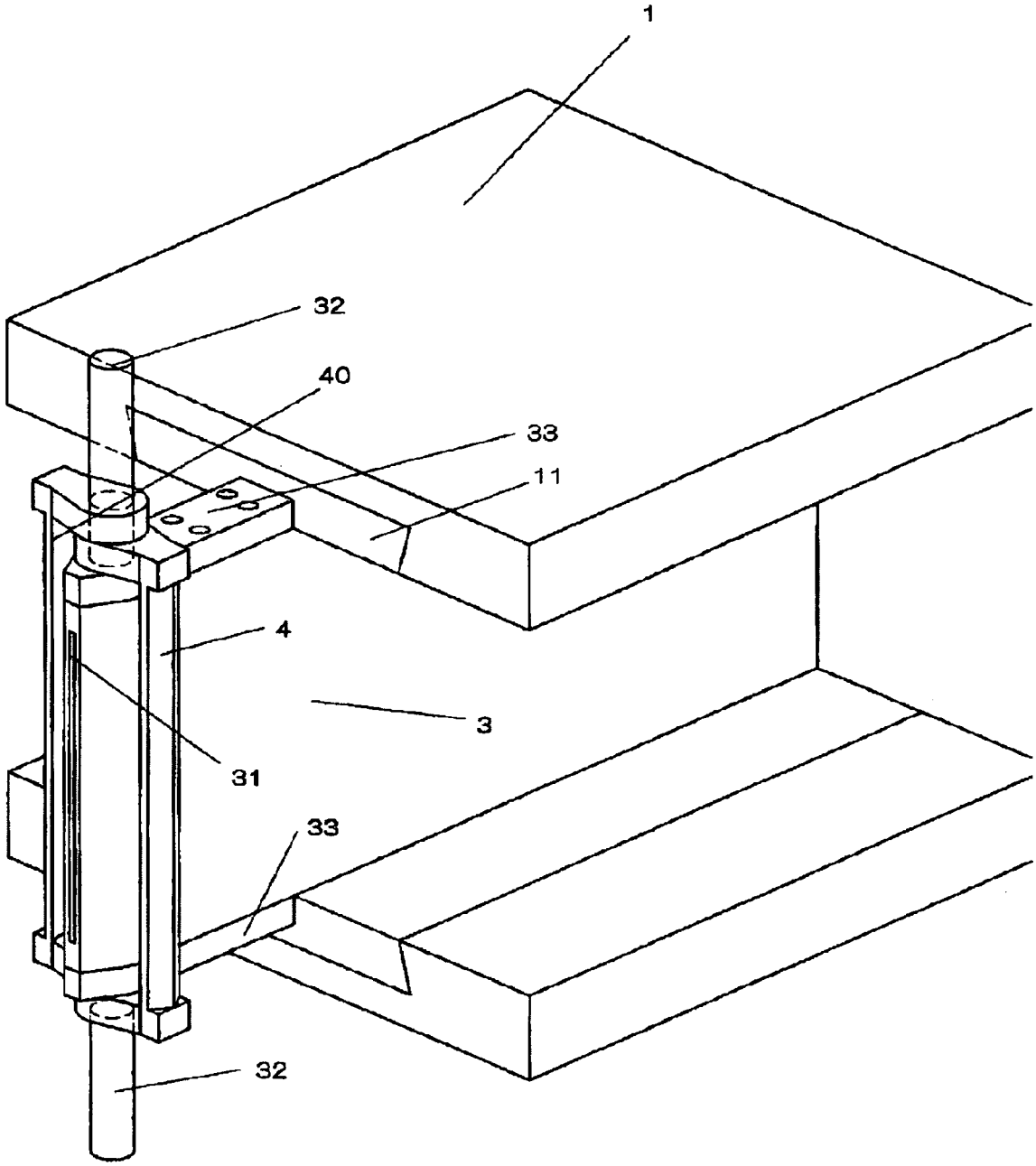
FIG. 3 is a perspective view illustrating a combination of the nozzle and bending tool of the present invention.

FIG. 1 is a perspective view illustrating a first embodiment of the automatic bending machine for the manufacturing of steel rule cutting dies of the present invention. A nozzle 3 for guiding a strip blade material 5 which is intermittently fed has nozzle supports 11 at the top and bottom thereof that are inserted into a machine cabinet 1. At the tip of the nozzle 3, a nozzle gate 31 from which the strip blade material 5 juts out is provided. At the top and bottom of the nozzle 3, a nozzle column 32 which penetrates through a concentric hole 41 in a CW-direction bending tool 4, and the same in a CCW-direction bending tool 40 is provided. In FIG. 3, the relationship among the nozzle 3, the CW-direction bending tool 4, and the CCW-direction bending tool 40 is illustrated in detail. In addition, FIG. 2 shows the CW-direction bending tool 4 and the CCW-direction bending tool 40 in detail. The CW-direction bending tool 4 or the CCW-direction bending tool 40 is turned around the nozzle gate 31 to strike the side of the strip blade material 5 to bend it. In the present invention, two different bending tools which are turned in a clockwise or counterclockwise direction when viewed from the top, for working, i.e., the CW-direction bending tool 4 and the CCW-direction bending tool 40, are provided. As can be seen from FIG. 2, these two have the same geometry like a vertical trough, with a bending tool support 42 extending at right angles at the top and bottom thereof. In the bending tool support 42, a concentric hole 41 through which the nozzle column 32 penetrates is provided. The CW-direction bending tool 4 and CCW-direction bending tool 40 are superposed one upon the other, and as shown in FIG. 3, are penetrated by the nozzle column 32 to be fixed to the nozzle 3. When viewed from the front, the CCW-direction bending tool 40 at the left side is superposed on the CW-direction bending tool 4 at the right side. To assemble in such a configuration, the nozzle column 32 is inserted into the CW-direction bending tool 4 and the CCW-direction bending tool 40 is placed on a column base 33, and then fixed with a screw to the column base 33 on the top and bottom of the nozzle 3, respectively. The nozzle 3 is inserted into the machine cabinet 1 by means of the integrated nozzle supports 11 at the top and bottom of the nozzle 3. The nozzle column 32 is further inserted into the upper belt wheel 2 or the lower belt wheel 21 which is turned by the timing belt 25. The timing belt 25 connects between the upper and lower synchronous belt wheel 27 and the upper belt wheel 2 or the lower belt wheel 21. The upper and lower synchronous belt wheel 27 is connected to the synchronous lower belt wheel 24 and the upper and lower synchronous belt wheel 27 by the synchronous shaft 26. The upper and lower synchronous belt wheel 27 is connected to a turning motor (not shown) by the timing belt 25. When the turning motor is run, the force is transmitted to the upper and lower synchronous belt wheel 27 to turn the upper belt wheel 2 and the lower belt wheel 21. On the back of the upper belt wheel 2 and the lower belt wheel 21, a protrusion 22 is provided, and when the motor is run, the protrusion 22 strikes the bending tool support 42.

Figures 1, 11:
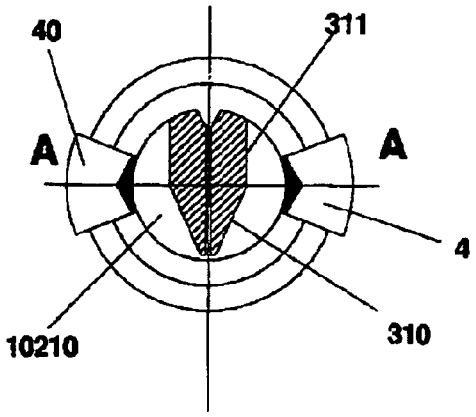
Figures 4, 11:
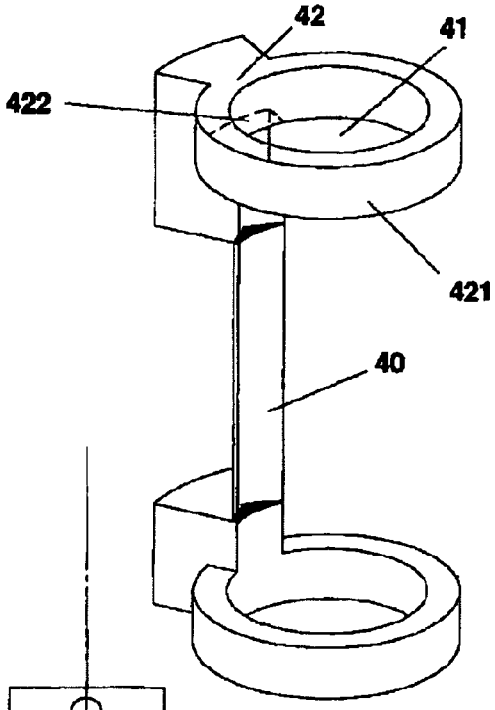
Figures 2, 11:
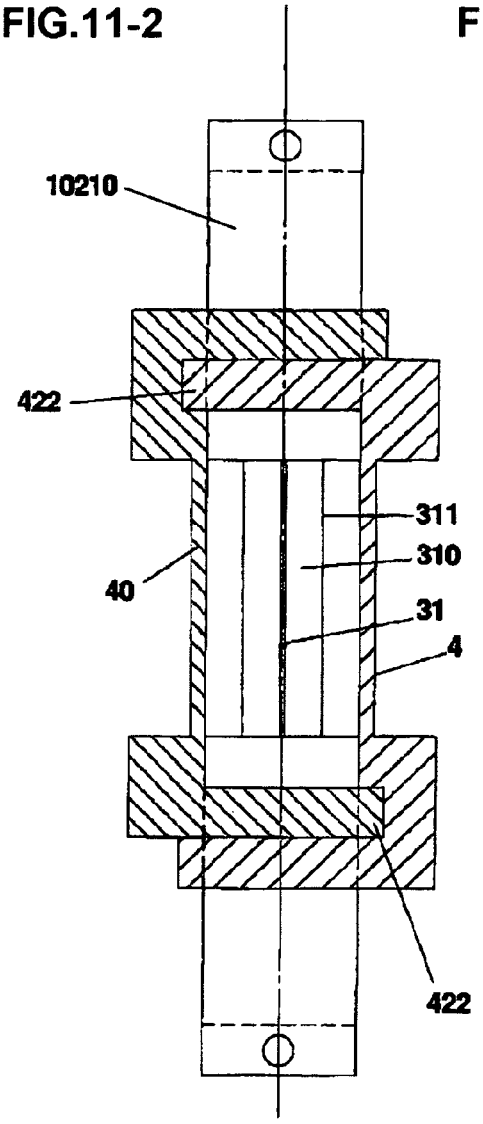
Figures 3, 11:
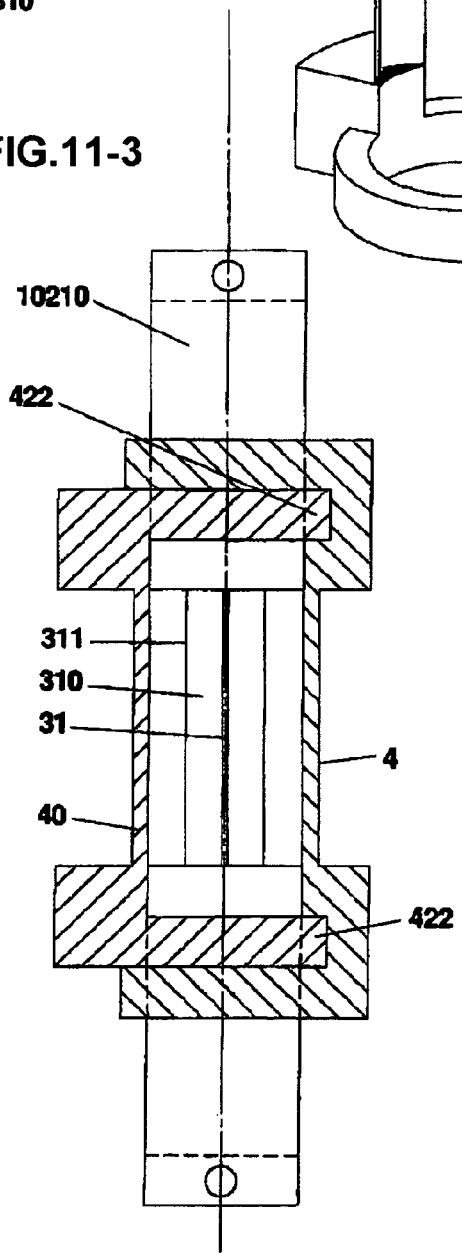

FIG. 4-A, FIG. 4-B, and FIG. 4-C illustrate the process of bending the strip blade material 5 by the tool of the present invention. FIG. 4-A shows the initial state, the CW-direction bending tool 4 and the CCW-direction bending tool 40 being in the home position. When the protrusion 22 is turned CCW, the CCW-direction bending tool 40 is struck against the strip blade material 5 as shown in FIG. 4-B. When the protrusion 22 is further turned CCW, the CCW-direction bending tool 40 and the nozzle gate 31 bend the strip blade material 5 by an angle of over 90 deg as shown in FIG. 4-C. As a result of such a configuration, the strip blade material 5 can be bent to an angle close to 130 deg, as compared to 90 deg with a construction as shown in FIG. 9-A FIG. 5-A shows a second embodiment of the automatic bending machine of the present invention. In this embodiment, a guide protrusion 43 is provided for each of the CW-direction bending tool 4 and the CCW-direction bending tool 40 in place of the protrusion 22 in the above-described embodiment, while the upper belt wheel 2 and the lower belt wheel 21 are provided with a guide groove 23. At both ends of the guide groove 23, a groove stopper 44 which butts against the guide protrusion 43 is provided. Thereby, the same effect as that which can be obtained by the above-described embodiment is given. However, even if the guide groove 23 is not provided, the CW-direction bending tool 4 and the CCW-direction bending tool 40 can be turned. Thus providing a guide groove is not a requisite for the present embodiment, and instead of the groove stopper 44, a protrusion 22 may be provided.

FIG. 8-A is a sectional side view of a third embodiment of the automatic bending machine of the present invention (drawing and description of the lower half section of the apparatus being omitted). With the present embodiment, the nozzle column 32 on the nozzle 3 is free from the load imposed by the timing belt in driving. Specifically, in order to make the nozzle column 32 free from the transmission of the force through the upper belt wheel 2 and the protrusion 22, the belt wheel 2 and the protrusion 22 are provided in the lower machine cabinet 101 extending from the machine cabinet 1. The belt wheel 2 comprises a hollow belt wheel 210 which is disposed concentrically with the nozzle column 32, and a tubular connecting element 212, being turned by the timing belt. The lower portion of the belt wheel 2 comprises a portion which turns with a needle bearing 211, and the bottom part on which the protrusion 22 is mounted. Thereby, the nozzle column 32 is free from the load imposed by the timing belt drive.

In addition, the nozzle column 32 on the top of the nozzle 3 may be reinforced because it is subjected to the bending pressure by the CW-direction bending tool 4 or the CCW-direction bending tool 40. To do this, a reinforcing tube 321 penetrating through the upper machine cabinet 102 extending from the machine cabinet 1 is provided concentrically with the nozzle column 32, and the nozzle column 32 is fixed thereto by means of a screw at the end. Thereby, the back of the nozzle 3 is inserted into the machine cabinet 1, and the top and bottom thereof are fixed to the reinforcing tube 321 in the present embodiment, which allows the nozzle 3 to withstand the striking impact applied by the CW-direction bending tool 4 or the CCW-direction bending tool 40. In FIG. 8-A, the CW-direction bending tool 4 is omitted for ease of understanding.

With the protrusion 22 as shown in FIG. 4-A, FIG. 4-B, and FIG. 4-C, a strong magnet 221 is embedded in the area where the protrusion 22 is struck against the bending tool support 42. The purpose of embedding of the magnet 221 is: When the strip blade material 5 is to be bent to form a desired circular arc, it is first fed by 1 mm, and struck once by the CW-direction bending tool 4 or the CCW-direction bending tool 40, then the CW-direction bending tool 4 or the CCW-direction bending tool 40 is once reversely turned to the retract position before the strip blade material 5 is fed by another 1 mm. Then, the strip blade material 5 is fed by another 1 mm, and is struck a second time by CW-direction bending tool 4 or the CCW-direction bending tool 40. A desired circular arc is thus formed by repeating this cycle, and this arc forming method is called the polyline method. This method involves reverse turning the CW-direction bending tool 4 or the CCW-direction bending tool 40 to the retract position. Therefore, a magnet is used, and as the magnet, a neodymium magnet is optimum. In the position as shown in FIG. 4-A, the CW-direction bending tool 4 and the CCW-direction bending tool 40 are attracted to the protrusion 22. In the position as shown in FIG. 4-B, the CW-direction bending tool 4 is butted against the side wall of the nozzle 3, being left there, and the CCW-direction bending tool 40 is further turned to bend the strip blade material 5 as shown in FIG. 4-C, and then the protrusion 22 is reversely turned to the retract position. Even during that reverse turning, the CCW-direction bending tool 40 can be returned to the retract position, being attracted and held by the magnet 221. This description of the bending operation is also applicable when the CW-direction bending tool 4 is used for carrying out a CW-direction bending.

In the present invention, the puller-back element for the CW-direction bending tool 4 and the CCW-direction bending tool 40 is not particularly limited to a magnet, and any type thereof may be adopted, provided that the puller-back element can return the CW-direction bending tool 4 or the CCW-direction bending tool 40 to the retract position when the protrusion 22 is reversely turned. Examples of other types of puller-back elements are shown in FIG. 6-A, FIG. 6-B, and FIG. 6-C. In FIG. 6-A, a ball plunger 222 is embedded in the protrusion 22 instead of the above-mentioned magnet. In FIG. 6-B, one end of the spring 223 is connected to the bending tool support 42, and the other end is to the nozzle support 11. In this case, in bending, the torque for the CW-direction bending tool 4 or the CCW-direction bending tool 40 overcomes the force of the spring 223, while, in reverse turning, the CW-direction bending tool 4 or the CCW-direction bending tool 40 is pulled back by the force of the spring 223 extended. In FIG. 6-C, both spring 223 are connected to the nozzle support 11. The effect of these other types of puller-back element is equivalent to that of the magnet 221.

With the embodiment as shown in FIG. 8-A (drawing and description of the lower half section of the apparatus being omitted), replacement of the tooling can be performed with ease. Generally, automatic bending machines bend the blade of 1.5 P with a thickness of 0.5 mm, 2 P with a thickness of 0.72 mm, 3 P with a thickness of 1.08 mm, or 4 P with a thickness of 1.44 mm. Thus, when the strip blade material 5 having a different thickness is to be bent, the nozzle 3, the CW-direction bending tool 4, and the CCW-direction bending tool 40 must be replaced with those for the different thickness. However, with the embodiment as shown in FIG. 1, the replacement operation takes so much time as would render it impracticable. On the contrary, with the embodiment as shown in FIG. 8-A, it is only required that the handwheel 322 for the reinforcing tube 321 be turned to disengage the screw at the bottom of the reinforcing tube 321 from the nozzle column 32; the nozzle 3, the CW-direction bending tool 4, and the CW-direction bending tool 40 be pulled forward to be removed; the desired tooling be inserted; and the reinforcing tube 321 be again fixed to the nozzle column 32 (description of the lower half section of the apparatus being omitted).

In the present invention, the CW-direction bending tool 4 and the CCW-direction bending tool 40 are not limited to those as shown in FIG. 2, and for example, those as shown in FIG. 7-A may be used. The CW-direction bending tool 4 and the CCW-direction bending tool 40 as shown in FIG. 7-A each consist of three components which are assembled using screws 45, thus rendering the manufacture easier. In this case, the need for the column base 33 as shown in FIG. 3 is eliminated, and the nozzle column 32 can be directly mounted into the nozzle 3. Then, after the bending tool support 42 is fitted to the nozzle column 32, the CW-direction bending tool 4 and the CCW-direction bending tool 40 are finally fixed using the screws 45, respectively. The CCW-direction bending tool 40 and the CW-direction bending tool 4 as shown in FIG. 7-A are mutually different in geometry, the CCW-direction bending tool 40 being accommodated in the inside of the CW-direction bending tool 4. Thus, the CW-direction bending tool 4 and the CCW-direction bending tool 40 need not always have the same geometry. FIG. 7-B shows a CW-direction bending tool 4 having another geometry. With this configuration, when the CW-direction bending tool 4 is worn, only the CW-direction bending tool 4 need be replaced with new one, with the bending tool support 42 being left mounted. This description is also applicable to the CCW-direction bending tool 40.

FIG. 8-B is a partially enlarged sectional side view of a modification of the embodiment as shown in FIG. 8-A. In this modification, a reinforcing rod 1021 is used in place of the reinforcing tube 321 in FIG. 8-A. The reinforcing rod 1021 is threaded at the end, and is fixed to an insertion hole 3211 which is provided in the top of the nozzle 3. In this case, there is no need for the nozzle column 32, and the end of the reinforcing rod 1021 penetrates through the concentric hole 41 in the respective bending tools to be fixed to the insertion hole 3211 by means of the screw.

In the embodiment as shown in FIG. 8-A (drawing of the lower half section of the apparatus being omitted), the respective protrusions 22 strike the respective bending tool supports 42, being synchronized through the upper belt wheel 2 and the lower belt wheel 21. However, both upper and lower belt wheels are not always required. Instead, only one of the upper and lower belt wheels may be provided. However, providing both upper and lower belt wheels eliminates the uneven distribution of the force on the strip blade material 5, which allows the size of the CW-direction bending tool 4 and the CCW-direction bending tool 40 to be reduced.

In a fourth embodiment as shown in FIGS. 10-1, FIGS. 10-2, and FIGS. 10-3; and FIGS. 11-1, FIGS. 11-2, FIGS. 11-3, and FIGS. 11-4, the upper and lower reinforcing tubes 321, the reinforcing rods 1021, and the nozzle 3 as shown in FIG. 8-A and FIG. 8-B are integrated to form a shaft 10210 which provides the nozzle 3 in the middle portion thereof.

Figures 1, 10:
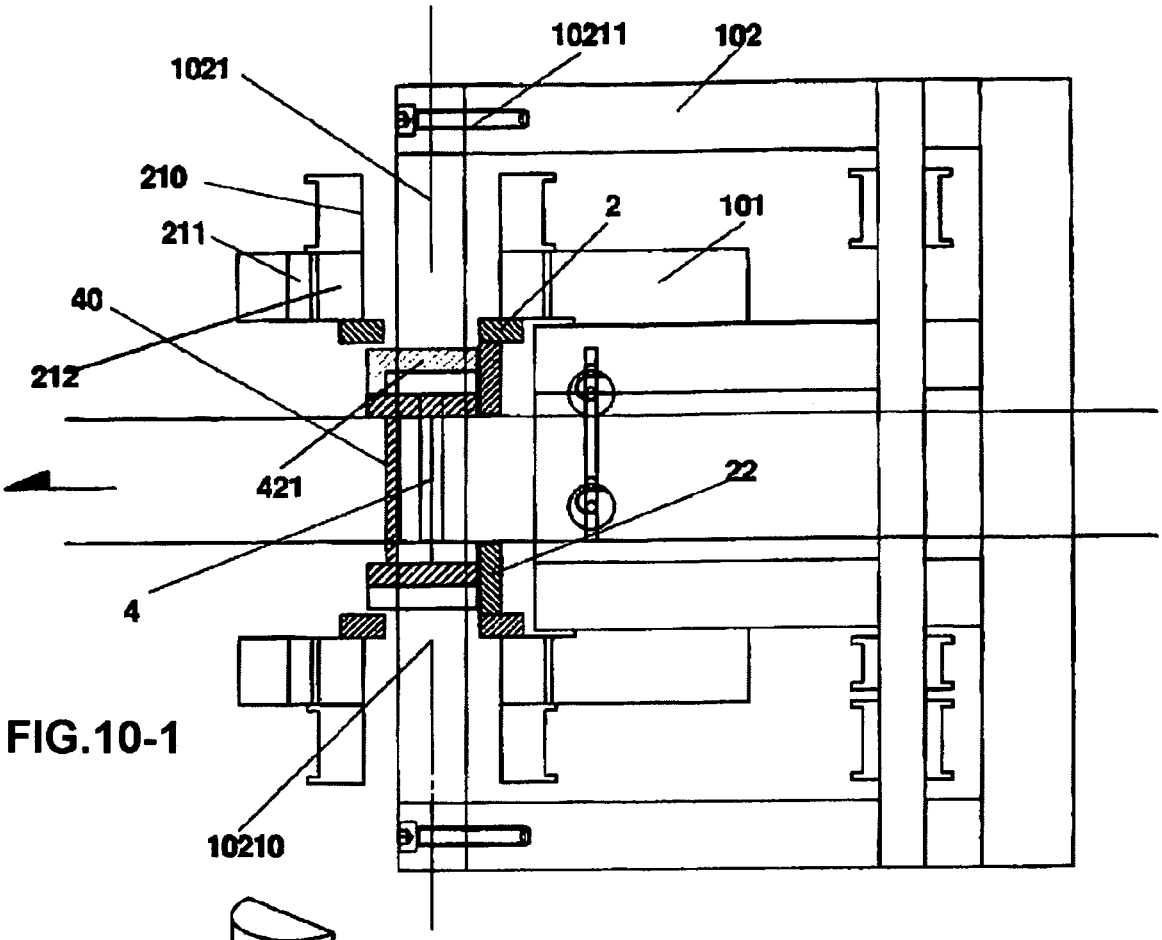
Figures 2, 10:
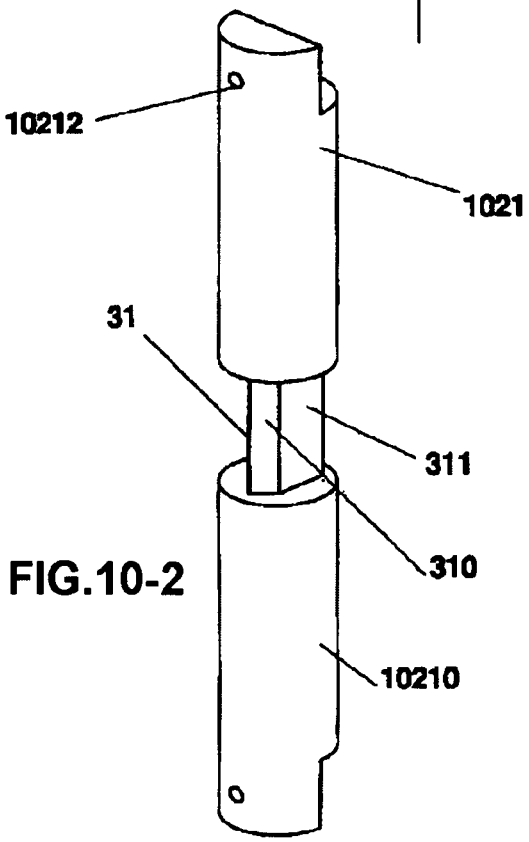
Figures 3, 10:
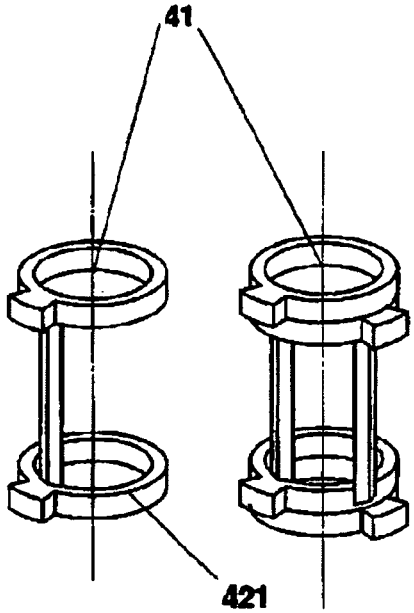

However, integration of the three members presents a problem that the bending tools 4, 40 could interfere with each other, which would make it impossible to concentrically assemble them with each other as shown in FIGS. 10-3. This problem, however, has been solved by providing an adequate geometry for the bending tools 4, 40, as described later.

In the present embodiment, the reinforcing rods 1021, the upper and lower reinforcing tubes 321, and the nozzle 3 as shown in FIG. 8-A and FIG. 8-B are integrated to form a shaft 10210 as shown in FIGS. 10-2. The shaft 10210 has a bolt hole 10212 in the upper and lower portions thereof for fixing it with a bolt 10211 to the upper machine cabinet 102, and, in the middle portion, a nozzle gate 31 through which a strip blade material 5 is fed. The nozzle 3 in this embodiment is provided with an inclination angle cut face 310 for bending as deeply as over 90 deg and, at the back thereof, a passage cut face 311 for facilitating passing of the bent blade material. FIGS. 10-1 also depicts a hollow belt wheel 210, a needle bearing 211, a tubular connecting element 212, and a protrusion 22.

On the other hand, the bending tool 4, 40 is provided with rings 421 having a concentric hole in the upper and lower portions as shown in FIGS. 11-4 for allowing the shaft 10210 to penetrate therethrough. Between the upper and lower rings 421, the bending tool 4, 40 is provided. FIGS. 11-4 is a perspective view of the CCW bending tool 40 in the assembly as shown in FIGS. 11-2. It must be noted that, in FIGS. 11-1, the sectional view of the bending tool 4, 40 has a solid portion, which indicates the "adequate geometry" as mentioned above in relation to FIGS. 10-3, and specifically expresses a ring relief groove 422 provided between the bending tool 40 and the upper ring 421 thereof or between the bending tool 4 and the lower ring 421 thereof (see FIGS. 11-2). In an example as shown in FIGS. 11-2, the CW bending tool 4 is provided with a geometry similar to that of the CCW bending tool 40, being fitted into each other. In another example as shown in FIGS. 11-3, the geometry of one bending tool is different from that of the other, the CW bending tool 4 being provided with two ring relief grooves 422. Thus, in the example as shown in FIGS. 11-2, the ring relief grooves 422 accommodate the ring 421 of the mating bending tools 4, 40, respectively, and in the example as shown in FIGS. 11-3, accommodate the rings 421 of the bending tool 40, and allow the shaft 10210 to penetrate through the concentric holes 41 in both bending tools.

As a result of this, the shaft 10210 which is caused to penetrate through both the CW bending tool 4 and the CCW bending tool 40 can be fixed to the upper machine cabinet 102, which assures that the shaft 10210 will not be deflected even over a long period of service. In addition, mounting and dismounting can be made within one minute.

The way of assembling suggested by the wording "being integrated" as used above excludes that made by means of screws, or the like, to allow disassembly at any time, but, of course, includes that by welding, brazing, or the like, of separate parts such that they cannot be disassembled.

The nozzle 3 in the present embodiment as shown in FIGS. 10-2 is provided with an inclination angle cut face 310 which allows bending at an angle over 90 deg.

The nozzle 3 in the present embodiment as shown in FIGS. 10-2 is also provided with a passage cut face 311. Thereby, if, after bending, the tip of the strip blade material 5 is located behind the shaft 10210, moving the bent strip blade material 5 forward for cutting will cause no jamming.

DESCRIPTION OF SIGNS

1: Machine cabinet
101: Lower machine cabinet
102: Upper machine cabinet
1021: Reinforcing rod
10210: Shaft
10211: Bolt
11: Nozzle support
2: Upper belt wheel
21: Lower belt wheel
210: Hollow belt wheel
211: Needle bearing
212: Tubular connecting element
22: Protrusion
221: Magnet
222: Ball plunger
223: Spring
23: Guide groove
24: Synchronous lower belt wheel
25: Timing belt
26: Synchronous shaft
27: Upper and lower synchronous belt wheel
3: Nozzle
31: Nozzle gate
310: Inclination angle cut face
311: Passage cut face
32: Nozzle column
321: Reinforcing tube
3211: Insertion hole
322: Handwheel
33: Column base
4: CW-direction bending tool
40: CCW-direction bending tool
41: Concentric hole
42: Bending tool support
421: Ring
422: Ring relief groove
43: Guide protrusion
45: Screw
44: Groove stopper
5: Strip blade material

What is claimed is:

1. An automatic bending machine for automatically bending a strip blade material, the automatic bending machine comprising:

a CW-direction bending tool provided with, at a top portion thereof, a first bending tool support and a first ring having a concentric hole, and at a bottom portion thereof, a second bending tool support and a second ring having a concentric hole;

a CCW-direction bending tool provided with, at a top portion thereof, a third bending tool support and a third ring having a concentric hole, and at a bottom portion thereof, a fourth bending tool support and a fourth ring having a concentric hole;

a shaft disposed so as to penetrate through the concentric holes of the first ring, the second ring, the third ring and the fourth ring;

a first ring relief groove provided between at least one of (i) the CW-direction bending tool and the first ring, and (ii) the CCW-direction bending tool and the third ring, the first ring relief groove being configured so as to accommodate therein a portion of one of the first ring and the third ring; and a second ring relief groove provided between at least one of (i) the CW-direction bending tool and the second ring, and (ii) the CCW-direction bending tool and the fourth ring, the second ring relief groove being configured so as to accommodate therein a portion of one of the second ring and the fourth ring;

wherein the shaft is provided with a nozzle gate through which the strip blade material is fed, and wherein the CW-direction bending tool or the CCW-direction bending tool is turned in a clockwise direction or a counterclockwise direction, respectively, to strike the strip blade material for bending it.

2. The automatic bending machine of claim 1, further comprising:

a lower belt wheel provided with a first protrusion, the first protrusion being in contact with at least one of the second bending tool support and the fourth bending tool support;

a hollow belt wheel;

a tubular connecting element provided inside of a needle bearing, the tubular connecting element being turned with the hollow belt wheel being turned; and an upper belt wheel connected to the tubular connecting element, the upper belt wheel provided with a second protrusion, and enclosing the shaft.

3. The automatic bending machine of claim 1, wherein the shaft is provided with an inclination angle cut face.

4. The automatic bending machine of claim 1, wherein the shaft is provided with a passage cut face.

* * * * *